US005968319A

United States Patent [19]

Grabscheid

[11] Patent Number: 5,968,319

[45] Date of Patent: Oct. 19, 1999

[54] DUAL EXTERNAL SUCTION BOXES FOR SUCTION ROLL FOR A PAPER MACHINE

[75] Inventor: Joachim Grabscheid, Gerstetten, Germany

[73] Assignee: Voith Sulzer Papiermaschinen, Heidenheim, Germany

[21] Appl. No.: 09/109,103

[22] Filed: Jul. 2, 1998

[30] Foreign Application Priority Data

Jul. 5, 1997 [DE] Germany ..... 197 28 823
Jul. 5, 1997 [DE] Germany ..... 197 28 824

[51] Int. Cl.[6] ..... D21F 1/48; D21F 3/10

[52] U.S. Cl. ..... 162/373; 162/368; 162/372

[58] Field of Search ..... 162/217, 367, 162/368, 373, 358.1

[56] References Cited

U.S. PATENT DOCUMENTS

| | | | |
|---|---|---|---|
| 3,057,402 | 10/1962 | Webster | 162/368 |
| 3,291,680 | 12/1966 | Justus et al. | 162/272 |
| 4,172,759 | 10/1979 | Kankaanpaa | 162/373 |
| 4,176,005 | 11/1979 | Bubik et al. | 162/300 |
| 4,406,739 | 9/1983 | Kankaanpaa | 162/301 |
| 4,923,568 | 5/1990 | Hietikko et al. | 162/301 |

FOREIGN PATENT DOCUMENTS

| | | |
|---|---|---|
| 340763 | 1/1978 | Austria . |
| 0639667 | 2/1995 | European Pat. Off. . |
| 311570 | 5/1917 | Germany . |
| 2741144 | 3/1978 | Germany . |
| 4103040 | 8/1992 | Germany . |
| 608257 | 12/1978 | Switzerland . |
| 713190 | 8/1954 | United Kingdom . |

*Primary Examiner*—Karen M. Hastings
*Attorney, Agent, or Firm*—Greenblum & Bernstein, P.L.C.

[57] ABSTRACT

Suction roll for a paper machine for dewatering a material web guided on transport belt in a web run direction. The suction roll includes a roll jacket over which the transport belt is guided, a first, external suction box that partially encompasses the suction roll and that is adapted to create a vacuum to suction the material web. The first suction box is adapted to suction at least one gusset formed between the roll jacket and the transport belt. The suction roll further includes a second suction box positioned to border the first suction box.

24 Claims, 1 Drawing Sheet

DUAL EXTERNAL SUCTION BOXES FOR SUCTION ROLL FOR A PAPER MACHINE

CROSS-REFERENCE TO RELATED APPLICATIONS

The present application claims priority under 35 U.S.C. § 119 of German Patent Application Nos. 197 28 823.5 and 197 28 824.3, both filed on Jul. 5, 1997, the disclosures of which are expressly incorporated by reference herein in their entireties.

BACKGROUND OF THE INVENTION

1. Field of the Invention

The present invention relates to a suction roll for dewatering a material web guided on a transport belt in a paper machine. The suction roll includes a roll jacket over which the transport belt is guided, and a first external suction box that partially encompasses an outer periphery of the roll jacket and that is adapted to create a vacuum that suctions a gusset formed between the material web and the roll jacket.

2. Discussion of Background Information

A suction roll of the type generally discussed above is known, e.g., from GB-A-713 190. In the known arrangement, a felt guides a material web over a guide roll and through downstream nips formed by an upper press roll and two lower press rolls. The first nip is formed by a lower press roll composed of a suction roll. A first suction box is positioned in front of the suction roll and is sealed against the suction roll and against the felt in a region between the gusset and the guide roll. A second suction box extends into the two gussets formed between the upper press roll and the suction roll and between the upper press roll and the other, i.e., downstream, lower press roll, and is sealed at the bottom against the surface of the suction roll and the downstream press roll.

The dewatering effect of the suction roll can be improved with the first suction box, however, sealing of the suction box against the felt in the vicinity of the inlet gusset and in the vicinity of the upstream guide roll is not adequately achieved by a sealing plate that extends over an entire width of the suction box and that extends from the upstream guide roll to a region just in front of the inlet gusset. A wide sealing plate of this type is complex and expensive, and, because it abrades the felt, is not particularly well suited for high web running speeds. Moreover, the second suction box is also complex and expensive in that it is difficult to mount due to the narrowed space conditions.

A further problem associated with known suction rolls of the type generally discussed above is that unwanted air is sucked in. In an attempt to avoid this problem, upstream suction boxes have been utilized in rolls discussed in, e.g., CH-A-608 257, AT-A-340 763, DE-A-2 741 144, DE-A-311 570, or U.S. Pat. No. 3,291,680.

In these publications, the suction roll is encompassed on both sides by the suction box, see, e.g., AT-A-340 763. However, this arrangement also suffers from the same drawbacks discussed above, e.g., suctioning unwanted air.

SUMMARY OF THE INVENTION

Therefore, the present invention provides a suction roll that is particularly suited for use in a region of a screen or press section of a paper machine, and that substantially avoids suction of unwanted air in a region of the gusset.

In accordance with the present invention, a suction roll of the type generally discussed above further includes a second suction box positioned directly adjacent to or bordering the first box.

In accordance with the present invention, the second suction box directly adjacent to the first suction box provides a stable, bend-resistant support body that provides sufficient stability for supporting a sealing strip in the gusset region, even in very wide machines. Furthermore, positioning the second suction box directly adjacent to the first suction box extends or lengthens a suction zone to form a continuous, uninterrupted total suction zone. This considerably improves the suction effect available in prior art arrangements in which the suction box was isolated, i.e., at a distance from the suction roll and in which no truly effective suction is achieved.

In accordance with a feature of the invention, the material web is suctioned by a vacuum via depressions in the roll jacket. In this manner, additional suction of the suction roll from the inside can be omitted, and the external, first suction box can be used to ensure a vacuum, even after the inlet gusset. In this embodiment, the depressions may be formed as blind bores in the surface of the roll jacket. This arrangement provides a particularly simple configuration of the suction roll, whereby additional inner seals can be omitted. Of course, the vacuum effect is limited to some extent. However, the vacuum created in this manner is sufficient to ensure reliable adhesion of the web to the transport or conveyor belt if the web is interrupted, or to ensure a reliable transfer from one transport belt to a second transport belt, e.g., felt—felt transfers within the press group.

In a further embodiment of the invention, the first suction box extends into the inlet gusset between the transport belt and the roll jacket, and the second suction box is located upstream of the first suction box with respect to a web run direction. Thus, sealing problems are substantially avoided, particularly in the region of the inlet gusset, and effective suction is substantially ensured.

In accordance with a further embodiment of the invention, the first suction box includes a central suction box that extends from the inlet gusset to the outlet gusset. A second suction box is located in front of the suction roll, relative to the web run direction, and is sealed against the transport belt, and a third suction box is located behind the suction roll, relative to the web run direction, and extends to the first suction box while being sealed against the transport belt.

In accordance with the present invention, this arrangement permits the transfer of a particularly powerful vacuum to the transport belt for dewatering the material web. Moreover, the vacuum may be adapted to special operating conditions through the use of the same or different vacuums for the suction boxes. For example, the second suction box may apply a lower vacuum while a greater vacuum is applied by the first suction box in the region in which the material web and the transport belt are in contact with the roll jacket, and a lower vacuum may again be applied by the third suction box to avoid disadvantageous influences on the material web at unusually high web running speeds. The use of suction boxes upstream and downstream of the central suction box requires a relatively low additional expenditure because bend-resistant cross-sections in the region of the inlet and outlet gussets are practically necessary anyway to obtaining the necessary rigidity for the external suction box.

Because the sealing of the suction boxes is provided directly against the transport belt, the suctioning of unwanted air in the region of the inlet gusset and in the region of the outlet gusset is substantially avoided. Further, suctioning of the suction roll via an external suction box permits the generation of a powerful vacuum with a large quantity of aspirated air, because the volume flow is not limited by the cross-sections of the axial bearing pins.

A further advantage of the suction roll of the present invention over conventional suction rolls having internal suction boxes is that the bores are constantly subjected to a vacuum. That is, in conventional suction rolls having internal suction boxes, the bores are exposed to the ambient pressure as soon as they exit the suction zone and must be evacuated again upon re-entering the suction zone. This results in additional energy requirements that are avoided with the present invention.

As mentioned above, the vacuum in the suction boxes may be separately set to permit optimum adaptation to different operating conditions.

In accordance with a further embodiment of the present invention, when utilizing a first, central suction box, the roll jacket may be penetrated by bores. This feature permits a more intense suction effect than in the a roll jacket having blind bores.

Sealing strips that extend transversely to the web run direction are utilized for sealing the suction boxes. A sealing strip may be provided particularly in the region of each gusset that is encompassed by one of the suction boxes. This ensures an effective sealing of the suction boxes to avoid leakage losses.

Of course, the features of the present invention described herein can be used not only in the disclosed exemplary combinations, but also alone or in other combinations within the scope of the invention.

The present invention is directed to a suction roll for a paper machine for dewatering a material web guided on transport belt in a web run direction. The suction roll includes a roll jacket over which the transport belt is guided, a first, external suction box that partially encompasses the suction roll and that is adapted to create a vacuum to suction the material web. The first suction box is adapted to suction at least one gusset formed between the roll jacket and the transport belt. The suction roll further includes a second suction box positioned to border the first suction box.

In accordance with another feature of the present invention, the roll jacket includes depressions. The material web may be suctioned by the vacuum via the depressions. Further, the depressions may include blind bores in a surface of the roll jacket.

In accordance with another feature of the present invention, the first suction box is structured to extend into an inlet gusset formed between the transport belt and the roll jacket, and the second suction box is located in front of the first suction box relative to the web run direction.

In accordance with still another feature of the present invention, the first suction box includes a central suction box structured to extend from an inlet gusset to an outlet gusset, and the second suction box is located in front of, and extends to, the first suction box relative to the web run direction, and is sealed against the transport belt. The suction roll also includes a third suction box that is located downstream of, and extends to, the first suction box relative to the web run direction, and that is sealed against the transport belt. Further, the roll jacket includes bores extending through the roll jacket, and the vacuum in each suction box, may be independently set. Still further, the suction roll includes sealing strips that extend transversely to the web run direction to seal the suction boxes.

The present invention is also directed to a suction roll assembly for dewatering a material web guided on a transport belt in a web travel direction. The assembly includes a roll jacket, a first suction box coupled to a partial outer peripheral surface of the roll jacket, and a second suction box positioned directly adjacent to the first suction box. The first and second suction boxes are adapted to be at least partially positioned in a gusset formed between the roll jacket and the transport belt.

In accordance with another feature of the present invention, a sealing strip is adapted to seal the first suction box against the peripheral surface and to seal the second suction box against the transport belt.

In accordance with still another feature of the present invention, a first vacuum supply may be coupled to the first suction box, and a second vacuum supply may be coupled to the second suction box, which is positioned to extend from an upstream position relative to the travel direction to the first suction box. The first vacuum supply is adapted to create suction along the peripheral surface and the second vacuum supply is adapted to create suction along the transport belt. Further, the first and second vacuum supplies may be coupled to a same vacuum source. Alternatively, the first and second vacuum supplies may be coupled to separate vacuum sources.

In accordance with a further feature of the present invention, the first and second suction boxes may extend along a length of the roll jacket.

In accordance with a still further feature of the present invention, the assembly may also include a third suction box positioned directly adjacent to the first suction box. The first and third suction boxes are adapted to be at least partially positioned in a second gusset formed between the roll jacket and the transport belt. Further, a first sealing strip is adapted to seal the first suction box against the peripheral surface and to seal the second suction box against the transport belt, and a second sealing strip is adapted to seal the first suction box against the peripheral surface and to seal the third suction box against the transport belt. Still further, a first vacuum supply may be coupled to the first suction box, and a second vacuum supply may be coupled to the second suction box. The second suction box may be positioned to extend from an upstream position relative to the travel direction to the first suction box. The assembly may also include a third vacuum supply coupled to the third suction box such that the third suction box is positioned to extend from the first suction box to a downstream position relative to the travel direction. The first vacuum supply is adapted to create suction along the peripheral surface and the second and third vacuum supplies are adapted to create suction along the transport belt. The first, second, and third vacuum supplies may be coupled to a same or different vacuum sources.

In accordance with still another feature of the present invention, the first and second suction boxes are adapted to form an extended length suction zone.

In accordance with yet another feature of the present invention, a sealing strip may be supported along its length by the first and second suction boxes.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
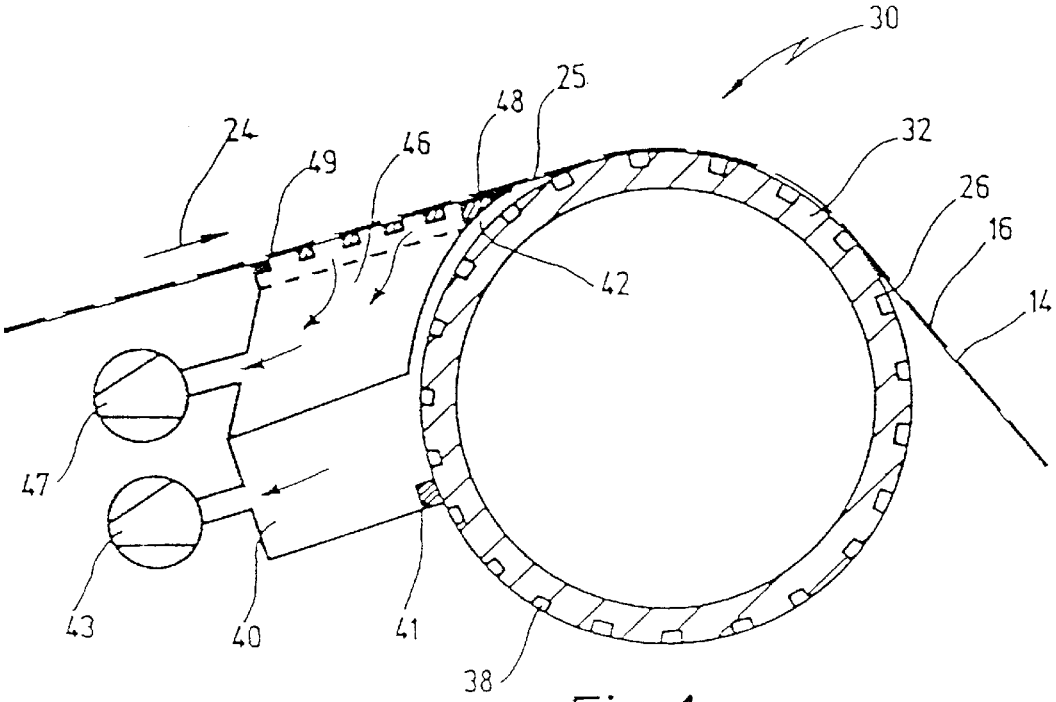
FIG. 1 illustrates a cross-sectional view of a first embodiment of a suction roll of the present invention.

FIG. 1 illustrates a suction roll 30 in accordance with a first embodiment of the present invention, that includes a rotatably-mounted roll jacket 32 having a plurality of depressions 38, e.g., blind bores, formed in its surface. A transport belt 14, e.g., a felt belt or screen, is guided over roll jacket 32 to guide or carry a material web 16, e.g., a paper web, to be dewatered in a web run direction 24.

A region in front of a line of contact between transport belt 14 and roll jacket 3 is referred to as an inlet or run-on gusset 25, while a region adjoining a line of separation of transport belt 14 from roll jacket 32 is referred to as an outlet or run-off gusset 26.

An external, first suction box 40 that partially encompasses a suction segment 42 of roll jacket 32 and that extends into the region of inlet gusset 25 is provided beneath the transport belt 14.

A second suction box 46 may be provided in front of, i.e., with respect to the web run direction, first suction box 46. Second suction box 40 may be directly adjacent to, i.e., border, first suction box 40 and may extend along transport belt 14 from an upstream position to the region of inlet gusset 25. To seal second suction box 46 against transport belt 14, a sealing strip 48 is provided at one end in the region of inlet gusset 25 and a sealing strip 49 is provided at the other end, i.e., positioned opposite inlet gusset 25. First suction box 40 may be sealed against the peripheral surface of roll jacket 32 by sealing strip 48 in the region of inlet gusset 25 and by a further sealing strip 41.

Suction boxes 40 and 46 may be coupled to a suitable vacuum source 43 or fan 47. Further, by utilizing first suction box 40 in conjunction with second suction box 46 in the manner discussed above provides a stable, bend-resistant support body that provides sufficient stability for supporting sealing strip 41 in the gusset region, even in very wide machines. Moreover, positioning second suction box 46 directly adjacent to first suction box 40 extends or lengthens a suction zone to form a continuous, uninterrupted total suction zone.

Figure 2:
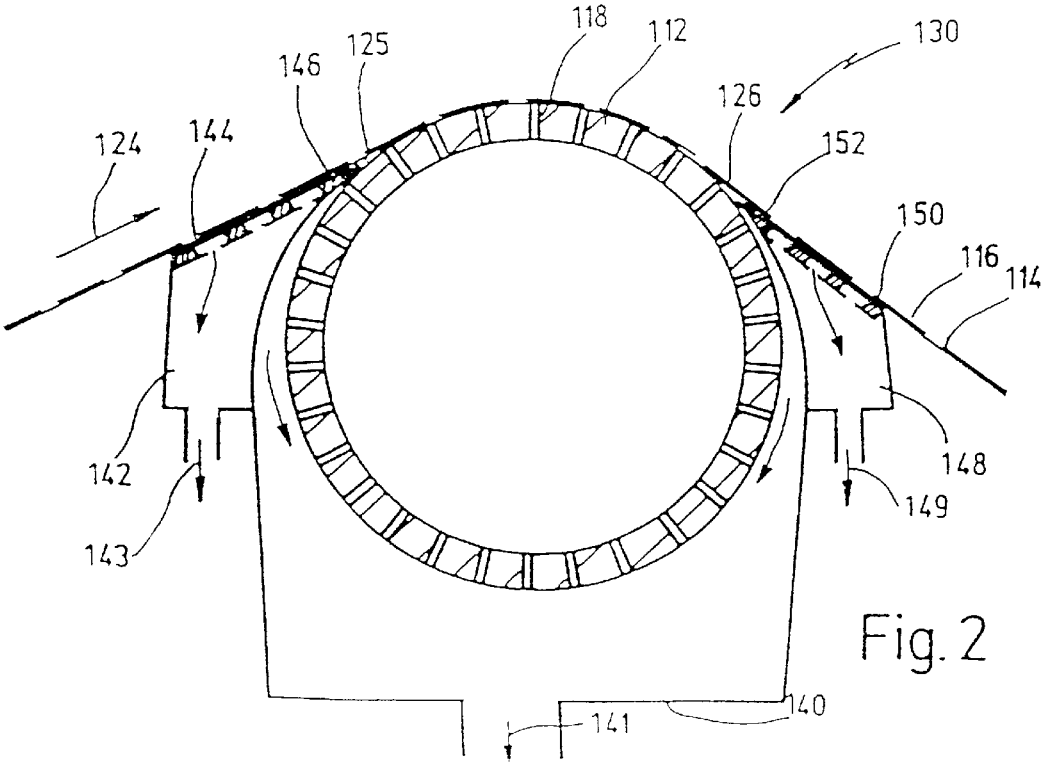
FIG. 2 illustrates a cross-sectional view of a second embodiment of a suction roll of the present invention.

FIG. 2 illustrates an alternative embodiment of the present invention of a suction roll 130. Unlike suction roll 30 described in conjunction with FIG. 1, suction roll 130 includes a central suction box 140 that surrounds a roll jacket 112 from an inlet gusset 125 to an outlet gusset 126. A second suction box 142 may be arranged in front of first suction box 140, relative to a web run direction 124, to extend along a transport belt 114 to inlet gusset 125. Second suction box 142 may be sealed against transport belt 114, which guides material web 116 to be dewatered, by sealing strips 144 on an inlet side and strips 146 in the region of inlet gusset 125.

Further, a third suction box 148 may be provided on an outlet side to extends along and beneath transport belt 114 from an outlet gusset 126 in web run direction 124. Third suction box 148 may be sealed against transport belt 114 by a sealing strip 152 in the region of outlet gusset 126 and by a sealing strip 150 at a downstream end. Central suction box 140, second suction box 142, and third suction box 148 may be coupled to a suitable vacuum source or sources, as indicated by arrows 141, 143 and 149, respectively.

Roll jacket 112 of suction roll 130 may be penetrated by bores 118. Bores 118 affect suction of transport belt 114 in the region between inlet gusset 125 and outlet gusset 126, i.e., through roll jacket 112.

Each individual suction box discussed in FIGS. 1 and 2 may be provided with a separate vacuum source to enable varying vacuum pressures to be exerted to enable optimal adaptation of the suction roll to the operating conditions. Alternatively, a single vacuum source may be utilized for all of the suction boxes, or several suctions boxes may be coupled to first vacuum source while other boxes are coupled to a second vacuum source.

Advantageous suctioning performance may be easily attained through the external suction of the suction roll, and, when combined with at least one additional suction box, the high stability necessary for the sealing strip is provided to achieve effective sealing in the gusset region, especially in wide paper machines operated at high web running speeds.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A suction roll for a paper machine for dewatering a material web comprising:

a transport belt structured and arranged to guide the material web in a web run direction;

a roll jacket over which the transport belt is guided;

a first, external suction box that partially encompasses the suction roll and that is structured and arranged to create a vacuum to suction the material web;

the first suction box being structured and arranged to suction at least one gusset formed between the roll jacket and the transport belt; and a second suction box being positioned to border the first suction box, and being sealingly coupled against the transport belt.

2. The suction roll in accordance with claim 1, the roll jacket comprising depressions, wherein the material web is suctioned by the vacuum via the depressions.

3. The suction roll in accordance with claim 2, the depressions comprising blind bores in a surface of the roll jacket.

4. The suction roll in accordance with claim 1, the first suction box being structured to extend into an inlet gusset formed between the transport belt and the roll jacket, and the second suction box being located in front of the first suction box relative to the web run direction.

5. The suction roll in accordance with claim 1, the first suction box comprising a central suction box being structured to extend from an inlet gusset to an outlet gusset;

the second suction box being located in front of, and extending to, the first suction box relative to the web run direction, and being sealed against the transport belt; and the suction roll further comprising:

a third suction box being located downstream of, and extending to, the first suction box relative to the web run direction, and being sealed against the transport belt.

6. The suction roll in accordance with claim 5, the roll jacket comprising bores extending through the roll jacket.

7. The suction roll in accordance with claim 5, wherein the vacuum in each suction box is independently set.

8. The suction roll in accordance with claim 5, further comprising sealing strips that extend transversely to the web run direction to seal the suction boxes.

9. The suction roll in accordance with claim 1, wherein the vacuum in each suction box is independently set.

10. The suction roll in accordance with claim 1, further comprising sealing strips that extend transversely to the web run direction to seal the suction boxes.

11. A suction roll assembly for dewatering a material web in a material web producing machine comprising:

a transport belt structured and arranged to guide the material web in a web run direction;

a roll jacket;

a first suction box coupled to a partial outer peripheral surface of the roll jacket;

a second suction box positioned directly adjacent to the first suction box;

the first and second suction boxes being structured and arranged to be at least partially positioned in a gusset formed between the roll jacket and the transport belt; and the second suction box being sealingly coupled against the transport belt.

12. The suction roll assembly in accordance with claim 11, further comprising a sealing strip being structured and arranged to seal the first suction box against the peripheral surface and to seal the second suction box against the transport belt.

13. The suction roll assembly in accordance with claim 11, further comprising:

a first vacuum supply coupled to the first suction box;

a second vacuum supply coupled to the second suction box, the second suction box being positioned to extend from an upstream position relative to the travel direction to the first suction box;

wherein the first vacuum supply is structured and arranged to create suction along the peripheral surface and the second vacuum supply is structured and arranged to create suction along, the transport belt.

14. The suction roll assembly in accordance with claim 13, the first and second vacuum supplies being coupled to a same vacuum source.

15. The suction roll assembly in accordance with claim 13, the first and second vacuum supplies being coupled to separate vacuum sources.

16. The suction roll assembly in accordance with claim 11, the first and second suction boxes extending along a length of the roll jacket.

17. The suction roll assembly in accordance with claim 11, further comprising:

a third suction box positioned directly adjacent to the first suction box;

the first and third suction boxes being structured and arranged to be at least partially positioned in a second gusset formed between the roll jacket and the transport belt.

18. The suction roll assembly in accordance with claim 17, further comprising:

a first sealing strip being structured and arranged to seal the first suction box against the peripheral surface and to seal the second suction box against the transport belt; and a second sealing strip being structured and arranged to seal the first suction box against the peripheral surface and to seal the third suction box against the transport belt.

19. The suction roll assembly in accordance with claim 17, further comprising:

a first vacuum supply coupled to the first suction box;

a second vacuum supply coupled to the second suction box, the second suction box being positioned to extend from an upstream position relative to the travel direction to the first suction box;

a third vacuum supply coupled to the third suction box, the third suction box being positioned to extend from the first suction box to a downstream position relative to the travel direction;

wherein the first vacuum supply is structured and arranged to create suction along the peripheral surface and the second and third vacuum supplies are structured and arranged to create suction along the transport belt.

20. The suction roll assembly in accordance with claim 19, the first, second, and third vacuum supplies being coupled to a same vacuum source.

21. The suction roll assembly in accordance with claim 19, the first, second, and third vacuum supplies being coupled to separate vacuum sources.

22. The suction roll assembly in accordance with claim 17, the first suction box comprising a central suction box being structured and arranged to extend from an inlet gusset to an outlet gusset.

23. The suction roll assembly in accordance with claim 11, farther comprising a sealing strip supported along its length by the first and second suction boxes.

24. The suction roll assembly in accordance with claim 11, the first and second suction boxes being structured and arranged to form an extended length suction zone.

* * * * *